US006652119B1

(12) United States Patent
Barton

(10) Patent No.: US 6,652,119 B1
(45) Date of Patent: Nov. 25, 2003

(54) MULTI-LAMP FLUORESCENT LIGHT FIXTURE

(76) Inventor: Bina M Barton, P.O. Box 131, Sunset Beach, CA (US) 90742

( * ) Notice: Subject to any disclaimer, the term of this patent is extended or adjusted under 35 U.S.C. 154(b) by 0 days.

(21) Appl. No.: 10/377,548

(22) Filed: Mar. 3, 2003

Related U.S. Application Data

(60) Provisional application No. 60/402,741, filed on Aug. 12, 2002.

(51) Int. Cl.[7] ..... F21Y 103/00

(52) U.S. Cl. ..... 362/225; 362/221; 362/260; 362/238; 362/241

(58) Field of Search ..... 362/236, 237, 362/238, 240, 241, 249, 260, 217, 221, 225

(56) References Cited

U.S. PATENT DOCUMENTS 4,246,629 A * 1/1981 Marrero ..... 362/147
4,253,135 A * 2/1981 Black ..... 362/249
5,349,508 A * 9/1994 Karbaf ..... 362/217

* cited by examiner

*Primary Examiner*—Laura K. Tso
(74) *Attorney, Agent, or Firm*—Monty Koslover

(57) ABSTRACT

A multi-lamp fluorescent light fixture which includes provision for mounting a linear fluorescent lamp on each of its for sides. A single ballast, contained inside the fixture reflector housing, is rated to start and supply four lamps and is wired for connection to up to four sets of bracket-mounted lamp sockets. The light fixture may be mounted in any of three orthogonal illumination directions using one to four installed lamps. A single invention light fixture can replace at least five presently available individual light fixtures, and provides new field installation options for contractors and customers.

2 Claims, 2 Drawing Sheets

MULTI-LAMP FLUORESCENT LIGHT FIXTURE

This application claims the benefit of provisional application Ser. No. 60/402,741 filed Aug. 12, 2002.

FIELD OF THE INVENTION

This invention relates to light fixtures for fluorescent lamps.

BACKGROUND

At present, a separate different light fixture is required for each fixture configuration holding one or more fluorescent lamps. In a given installation, this may vary from one or two different configuration fixtures to a multiple number. Manufacturers must therefore make and stock a commensurate number of individual, different configuration light fixtures for fluorescent lamps, as well as different sizes.

It would therefore be useful to provide a single light fixture that can hold a multiple number of different configurations of fluorescent lamps.

SUMMARY OF THE INVENTION

The invention is a multi-lamp fluorescent light fixture which includes provision for mounting a linear fluorescent lamp on each of its four longitudinal sides. A single ballast rated to supply four lamps is included inside the fixture reflector housing and the ballast is wired for connection to up to four sets of bracket-mounted lamp sockets. The light fixture may be mounted in any of three orthogonal illumination directions using one to four installed lamps. This results in at least twelve fixture installation options available for an installer.

Accordingly, it is a prime object of the invention to provide a single fixture that can hold a multiple number of different configurations of fluorescent lamps.

Another object is to provide a lamp fixture that is wired to start and supply up to four lamps simultaneously, using one ballast.

Yet another object is to replace at least five individual linear fluorescent light fixtures with a single, multi-lamp fixture.

DESCRIPTION OF THE PREFERRED EMBODIMENT

The invention is a multi-lamp fluorescent light fixture which is designed to mount a linear fluorescent lamp on each of its four sides.

Figure 1:
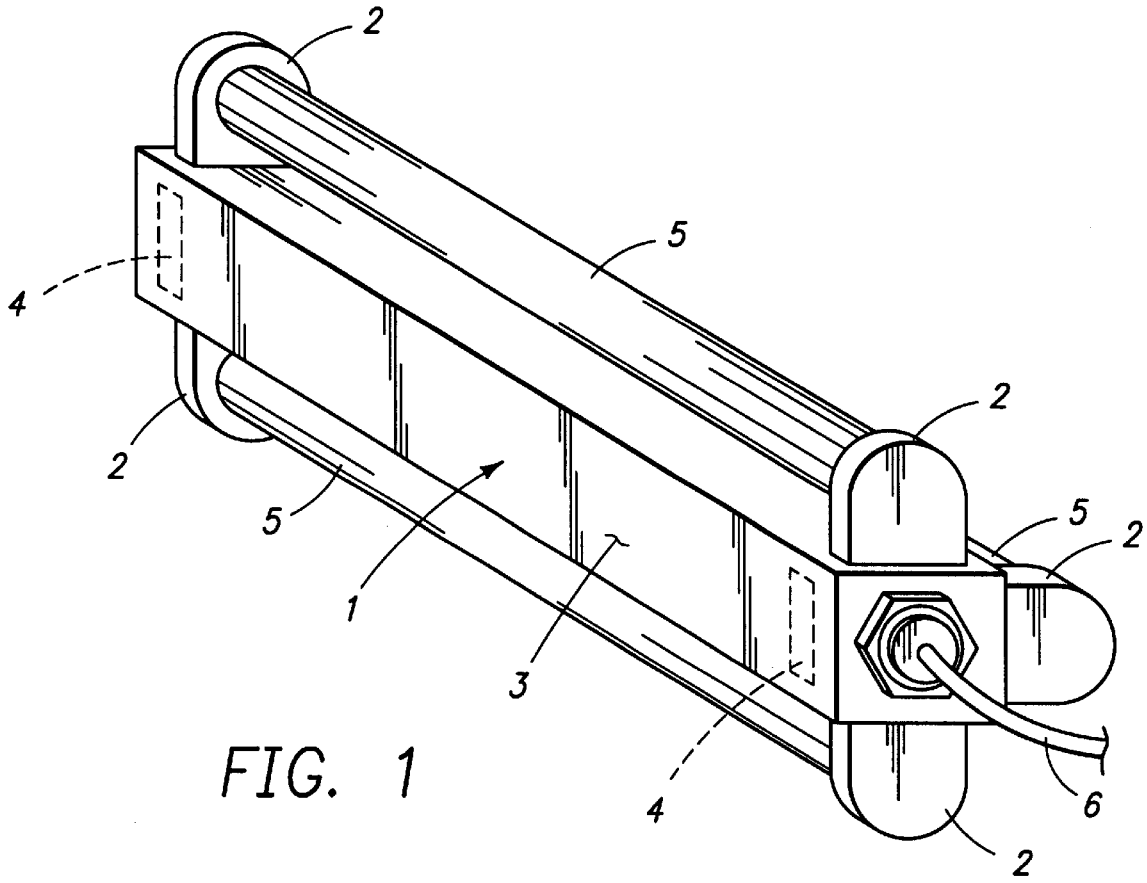
FIG. 1 is a perspective view of the present invention light fixture showing linear fluorescent lamps mounted on three of its four available sides.

Refer to FIG. 1. In this perspective view the light fixture 1 has three fluorescent lamps 5 installed in the sockets of mounting brackets 2 on three of the reflector housing 3 sides. One reflector housing side is not used here, and shows two knock-outs 4 which may receive mounting brackets 2 to connect another lamp. Inside the reflector housing 3 is a single electronic ballast that starts and operates up to four lamps as required by lamp placements. Provision is made for connecting an input power cable 6 to one end of the fixture for connection to the ballast.

Figure 2:
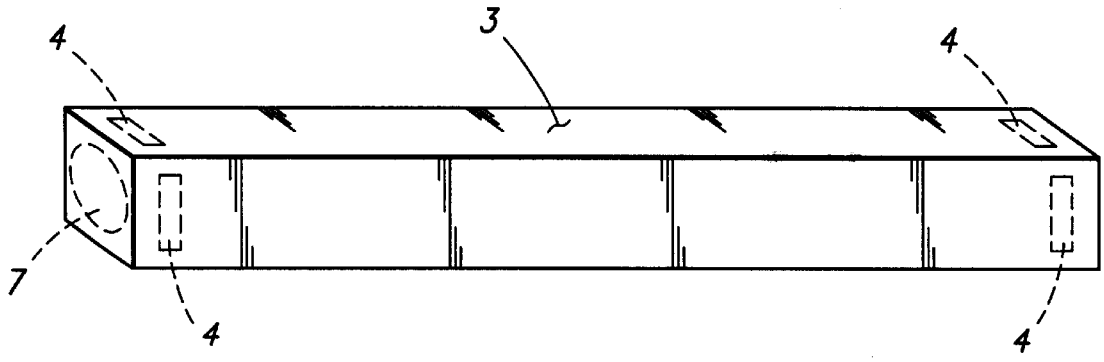
FIG. 2 is a side perspective view of a reflector housing of the light fixture according to the present invention, particularly showing side knock-out slots for receiving lamp mounting brackets, and end knock-outs for wiring access.

The fixture reflector housing 3 itself, as illustrated in FIG. 2, is an enclosed tubular, square cross-section metal assembly, with flat sides and having no installed lamp mounting brackets 2. As indicated, there are two knock-outs 4 each on all four sides of the reflector housing that may be opened to receive mounting brackets 2.

These knock-outs 4 are normally located adjacent to the ends of the reflector housing 3 as depicted in FIGS. 1 and 2. However, as a customer option, the knock-outs 4 on any side could be located each a distance away from the ends, so that the lamp mounting brackets 2 installed in the knock-outs can hold a short length, lower rated lamp than those on other sides.

The reflector housing 3 also includes a knock-out 7 at each end to accommodate a wiring cable 6 that connects the ballast inside the reflector housing to the power supply. Provision is made for suspension or fastening of the fixture to a support from any side of the fixture reflector housing. For example, for the configuration illustrated in FIG. 1, suspension and fastening might probably be located on the reflector housing side having no installed lamp. However, it need not be so. The choice depends on the user's particular installation needs.

Figure 3A:
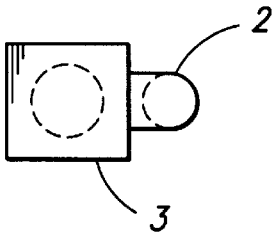
FIGS. 3*a*–3*e* are end views of the invention light fixture showing five differing lamp mounting bracket configurations on a single light fixture.
Figure 3B:
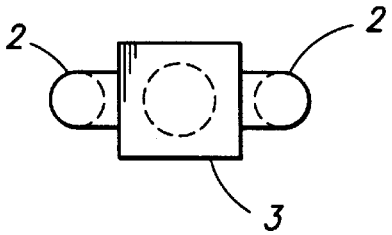
Figure 3C:
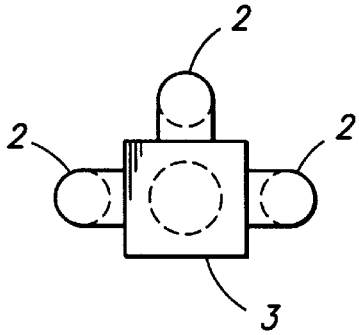
Figure 3D:
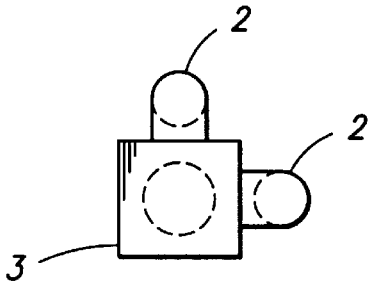
Figure 3E:
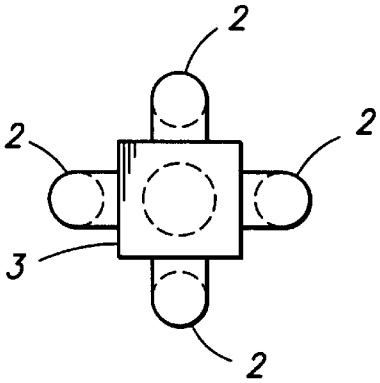

Referring now to FIGS. 3*a*–3*e,* there are represented in end profile, five possible placement options for mounting one to four fluorescent lamps on the fixture reflector housing 3. As can be seen in FIGS. 3*b* and 3*d,* there are two possible configurations for mounting two lamps: opposite each other or at 90 degrees apart. Since there is no designated "top" side to the fixture, the three-lamp configuration fixture shown in FIG. 3*c* may be revolved 90 deg. or 180 deg. so that the lamps project to the right or below. Similarly, the lamp configurations shown in FIGS. 3*a,* 3*b* and 3*d* may be revolved so that the lamps illuminate in another direction when mounted. Thus, the lamp fixtures shown in FIGS. 3*a*–3*d* may each be mounted for illumination in three different orientations: upward, downwards and to one side, resulting in twelve available fluorescent lamp installation options for applications. Yet another lamp installation application is provided by the four-lamp fixture configuration shown in FIG. 3*e*. This fixture would probably be suspended from above. Thus, at least five individual linear lamp fixtures can be replaced by the single invention light fixture.

These lamp placement and fixture orientation options are offered as examples of the versatility of the invention fixture. Further options include the use of different sizes of fluorescent lamps, installed on a single invention light fixture.

Figure 4:
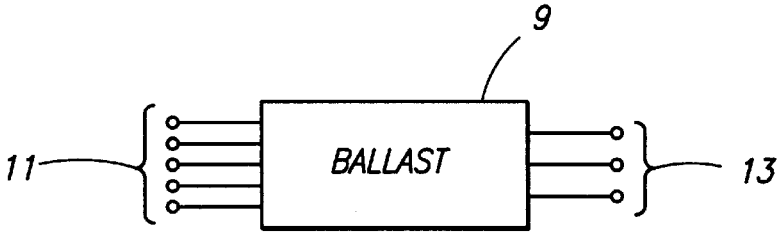
FIG. 4 is a block diagram of the electrical equipment and wiring contained inside the reflector housing of the invention light fixture.

Referring now to FIG. 4, a single ballast 9 which is rated to start and supply four linear fluorescent lamps, is located inside the fixture reflector housing. Input power wiring 13 is connected to the ballast 9 and brought out through an end of the reflector housing for connection to a power source. Ballast output power wiring 11, sufficient for connection to four lamps, is connected to lamp mounting sockets in installed brackets 2 as required for a given fixture configuration.

The benefits of the device are several: lamp fixture inventory levels can be reduced, creating less space for storage shelving requirements.

Production of lamp fixtures can be increased by manufacturing a larger volume of one type of multi-lamp fixture. This in turn, can lead to a lower selling cost to customers. Also, the multi-lamp fluorescent light fixture gives contractors and customers alike, field installation options where none previously existed.

From the foregoing description, it is believed that the preferred embodiment achieves the objects of the present invention. Alternative embodiments and modifications will be apparent to those skilled in the art. These and other modifications are considered to be equivalent and within the spirit and scope of the present invention.

Having described the invention, what is claimed is:

1. A linear fluorescent lamp fixture, comprising:

a reflector housing that is sized in length for a single, linear lamp; said reflector housing being an enclosed, metal sided, tubular assembly having a square cross-section; each of the assembly four flat, linear sides including a knock-out slot that is located adjacent to each end of a side;

a multiplicity of lamp mounting brackets; each mounting bracket including provision for installation in said reflector housing through a knock-out slot;

an electric power ballast that is located inside said reflector housing; said ballast being rated to start and supply four linear fluorescent lamps; and electrical wiring contained inside said reflector housing, connecting said ballast to an input power connector, and to all installed mounting brackets of up to four paralleled lamps.

2. The linear fluorescent lamp fixture according to claim 1 wherein:

said lamp mounting brackets may be installed on any of said sides of said reflector housing, located a distance from each reflector housing end, and adapted to mount a shorter length fluorescent lamp than the fixture length permits.

* * * * *